US005820108A

United States Patent [19]

Ostrobrod

[11] Patent Number: 5,820,108

[45] Date of Patent: Oct. 13, 1998

[54] MONOPOD ANCHORING DEVICE

[76] Inventor: Meyer Ostrobrod, 2070 Bennett Rd., Philadelphia, Pa. 19116

[21] Appl. No.: 878,732

[22] Filed: Jun. 19, 1997

Related U.S. Application Data

[63] Continuation of Ser. No. 517,822, Aug. 21, 1995, abandoned.

[51] Int. Cl.[6] ..... B66D 1/26

[52] U.S. Cl. ..... 254/281; 254/288; 254/327; 254/332

[58] Field of Search ..... 254/281, 288, 254/326, 327, 332, 329; 182/239, 236

[56] References Cited

U.S. PATENT DOCUMENTS

| | | | |
|---|---|---|---|
| 2,604,303 | 7/1952 | Grady | 254/327 X |
| 2,666,212 | 1/1954 | Flanders | 254/326 X |
| 4,287,963 | 9/1981 | Coxsey | 182/236 X |
| 4,511,123 | 4/1985 | Ostrobod | 254/364 |
| 4,589,523 | 5/1986 | Olson et al. | 182/239 X |
| 4,706,939 | 11/1987 | Gagne | 254/332 |
| 5,147,013 | 9/1992 | Olson et al. | 182/236 X |
| 5,217,084 | 6/1993 | Olson et al. | 182/234 |

*Primary Examiner*—Donald P. Walsh
*Assistant Examiner*—Emmanuel M. Marcelo
*Attorney, Agent, or Firm*—Norman E. Lehrer

[57] ABSTRACT

A monopod anchoring device for facilitating the entry or removal of a workman or equipment into a cavity. The device is adapted to engage an eyelet or the like that extends from a support structure located above the cavity and includes a head member and a leg member extending downwardly therefrom. Secured to one side of the head member is a pulley assembly. A safety device is secured to the leg member and includes a housing with a drum and a drum shaft mounted therein and a safety line that is adapted to be wrapped around the drum. The safety line is positioned over the pulley assembly and has one end secured to the drum and another end secured to the object to be raised or lowered. A hook extends upwardly from the head member in order to secure the monopod anchoring device to the eyelet. Secured to the end of the leg member distal the hook is a transverse cross member which has a pair of feet extending downwardly therefrom for frictionally engaging a support surface.

13 Claims, 5 Drawing Sheets

152
16
150
12
20
2
14
76
78
90
72
68
10
96
18
70
94
92
66
94
144
74
124
140
128
122

MONOPOD ANCHORING DEVICE

This is a continuation of prior application Ser. No. 08/517,822, filed Aug. 21, 1995, now abandoned.

BACKGROUND OF THE INVENTION

The present invention is directed toward a monopod anchoring device and, more particularly, to a device for raising or lowering a workman into or out of a relatively deep cavity such as an opening in a large industrial tank.

The invention has particular use with fall protection devices such as shown in Applicant's U.S. Pat. No. 4,511,123. More specifically, a fall prevention device of this kind typically includes a housing which is adapted to be suspended from an elevated structure above a relatively large opening. A cable winding drum is rotatably mounted in the housing and a spiral spring drives the drum in a direction which continuously tends to wind the cable around the drum. A centrifugally operated brake mechanism responds to an initial fast rotation of the drum in the unwinding direction and brakes the rotation of the drum to prevent further unwinding thereof. This protects a workman from injury that would otherwise occur as a result of a rapid fall.

There are various known devices for raising and lowering objects, such as workmen or equipment, into areas which are not readily accessible. The devices allow the objects to be lowered or raised at a controlled speed. U.S. Pat. No. 5,217,084 shows such a device. A drawback with these known devices is that they include several leg members which are significantly spaced from one another. Accordingly, a large surface area is required in order to sufficiently support the device. For example, the device shown in U.S. Pat. No. 5,217,084 discloses a fall arresting device that includes a housing with a plurality of diverging legs extending therefrom. Each leg has a foot secured thereto. A winch assembly is mounted to one of the legs and includes a cable which is attached to a harness or belt of a workman or other object. In order for this device to be adequately supported, each foot must be placed on substantially level ground. Since each foot is significantly spaced from the other feet, a relatively large ground surface area is required to support the device. Another problem with existing devices is they are very difficult to maneuver because of their relatively large size and weight.

There are times when a sufficient horizontal support surface is not available for tripod devices. This occurs, for example, when a workman has to enter a large tank from a small opening in the top thereof. The top surface of the tank may be curved or arcuate and will not support a device such as shown in U.S. Pat. No. 5,217,084.

SUMMARY OF THE INVENTION

The present invention is designed to overcome the deficiencies of the prior art discussed above. It is an object of this invention to provide a monopod anchoring device that is utilized to lower or raise an object into and out of a cavity.

It is a further object of the invention to provide such a device that complies with relevant governmental regulations.

It is yet another object to provide such a device that can be installed quickly and easily.

In accordance with the illustrative embodiments, demonstrating features and advantages of the present invention, there is provided a monopod anchoring device for facilitating the entry or removal of an object into or out of a cavity that includes a substantially flat head member with a forwardly projecting segment. A leg member extends downwardly and outwardly from the head member. Mounted to the leg member is a safety device which is adapted to support an object suspended therefrom. A hook is secured to the top of the forwardly projecting segment of the head member and extends upwardly therefrom in order to secure the monopod anchoring device to an eyelet. The eyelet is typically attached to a support structure located above the cavity.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
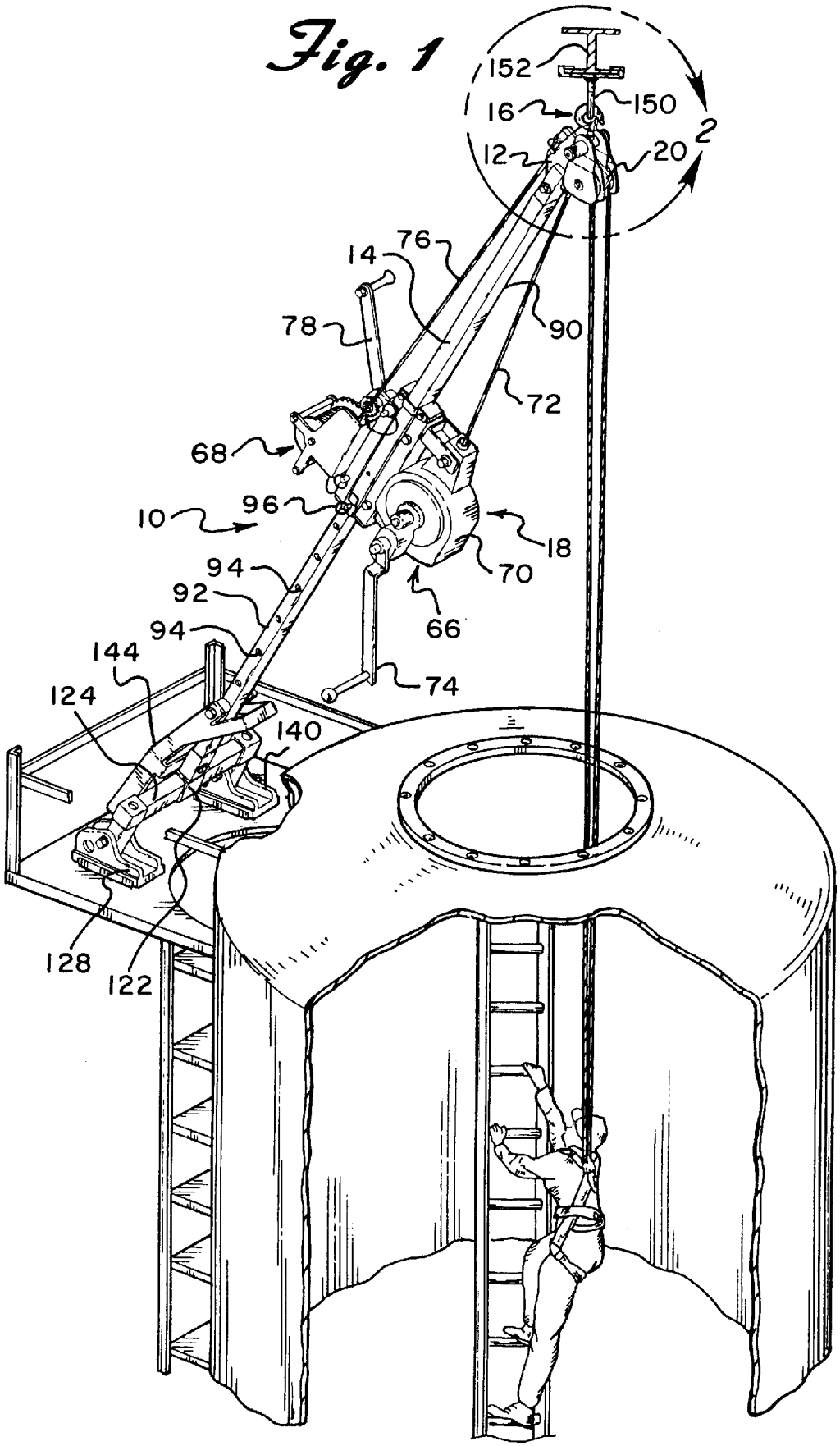
FIG. 1 is a perspective view of the monopod anchoring device of the present invention shown supported above an industrial tank.

Referring now to the drawings in detail wherein like reference numerals have been used throughout the various figures to designate like elements, there is shown in FIG. 1 a monopod anchoring device for raising or lowering an object into or out of a relatively deep cavity constructed in accordance with the principles of the present invention and designated generally as 10.

The device 10 is comprised of a substantially flat head member 12, an elongated leg member 14 extending downwardly and outwardly from the head member 12, a hook assembly 16 extending upwardly from the head member and a support assembly 18 adapted to support an object suspended therefrom. In the preferred embodiment, the support assembly 18 is removably attached to the leg member 14 as more fully described below.

Figure 3:
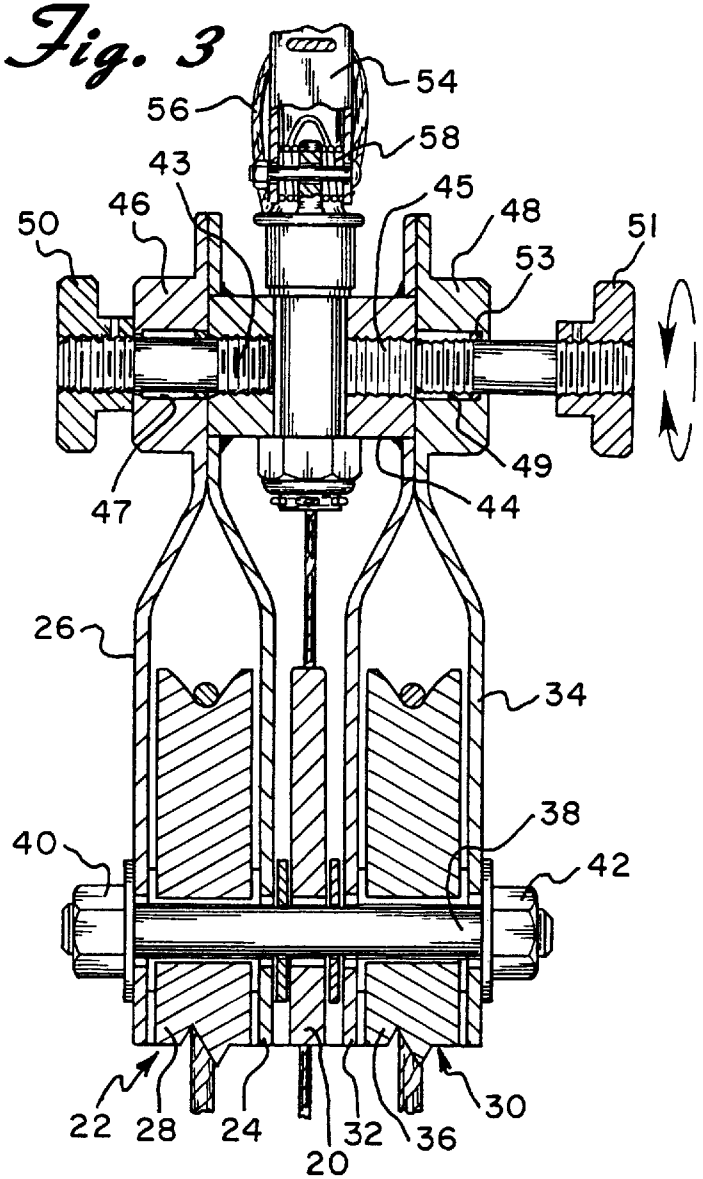
FIG. 3 is a cross-sectional view taken along lines 3—3 of FIG. 2.
Figure 2:
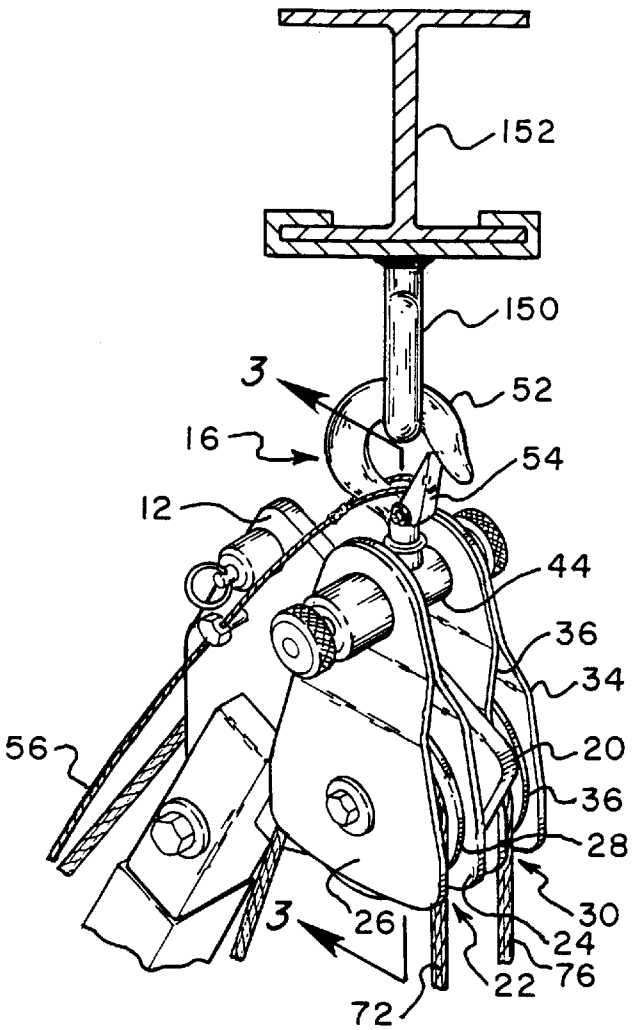
FIG. 2 is a partial perspective view taken along line 2 of FIG. 1.

Referring to FIGS. 2 and 3, the head member 12 includes a forwardly projecting segment 20. Pulley assembly 22 is located adjacent one side of the segment 20 and includes a pair of plate members 24 and 26 and a pulley 28 positioned therebetween. Pulley assembly 30 is located adjacent the other side of segment 20 and includes a pair of plate members 32 and 34 and a pulley 36 positioned therebetween. An axle 38 extends through pulley assembly 22, through outwardly projecting segment 20 and through pulley assembly 30. The axle has a pair of opposing threaded ends. Nuts 40 and 42 are threaded over the ends of the axle 38 in order to secure the pulley assemblies to the outwardly projecting segments. The plate members 26 and 34 are preferably rotatably mounted around the axle 38.

A horizontally disposed shaft 44 is secured by welding or the like between the plate members 24 and 32 and has threaded recesses 43 and 45 formed in opposite sides thereof. The upper portion of each of the plate members 26 and 34 has a protrusion 46 and 48, respectively, extending outwardly therefrom. Each of the protrusions has a bore 47 and 49 formed therethrough. Screws 50 and 51 are each inserted through a corresponding one of the bores 47 or 49 in the protrusions 46 and 48, respectively, and threadably engage the threaded recesses 43 and 45 formed in the shaft 44 in order to secure plate members 26 and 34 in place. As shown most clearly in FIG. 3, when one of the screws such as screw 51 is rotated counterclockwise, the forward threaded end withdraws from the threaded recess 45 and is located within the bore 49. Total removal of the screw 51 is prevented by the stop element 53 mounted thereon.

Figure 4:
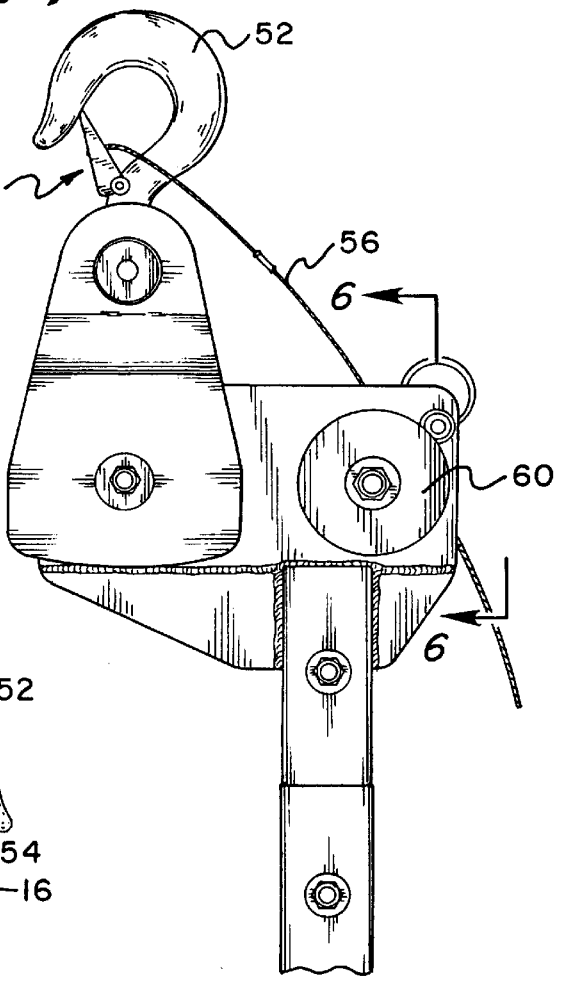
FIG. 4 is a right side view of the hook assembly.
Figure 5:
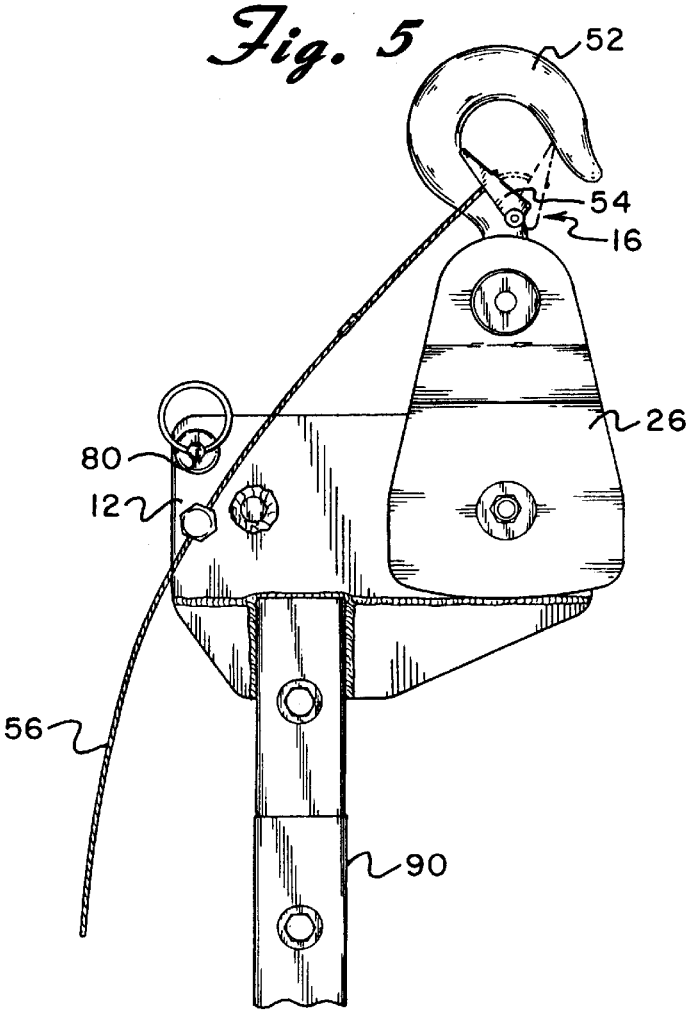
FIG. 5 is a left side view of the hook assembly.

The hook assembly 16 extends upwardly from shaft 44 between plate members 24 and 32. The hook assembly includes a snap hook 52 with a spring biased swivel arm 54 which closes the snap hook in order to prevent the accidental removal of the hook from the structure it is attached to. The snap hook is pivotally mounted to the hook assembly and can rotate 360° about the same. In the preferred embodiment, a thin cable wire 56 has one end secured to the swivel arm 54. When the wire 56 is pulled by a workman, the swivel arm is pulled back against the restoring force of spring 58 thereby opening the hook 52 (see FIGS. 3–5). When the wire 56 is released, the restoring force of spring 58 causes the swivel arm to close off the hook 52.

Figure 7:
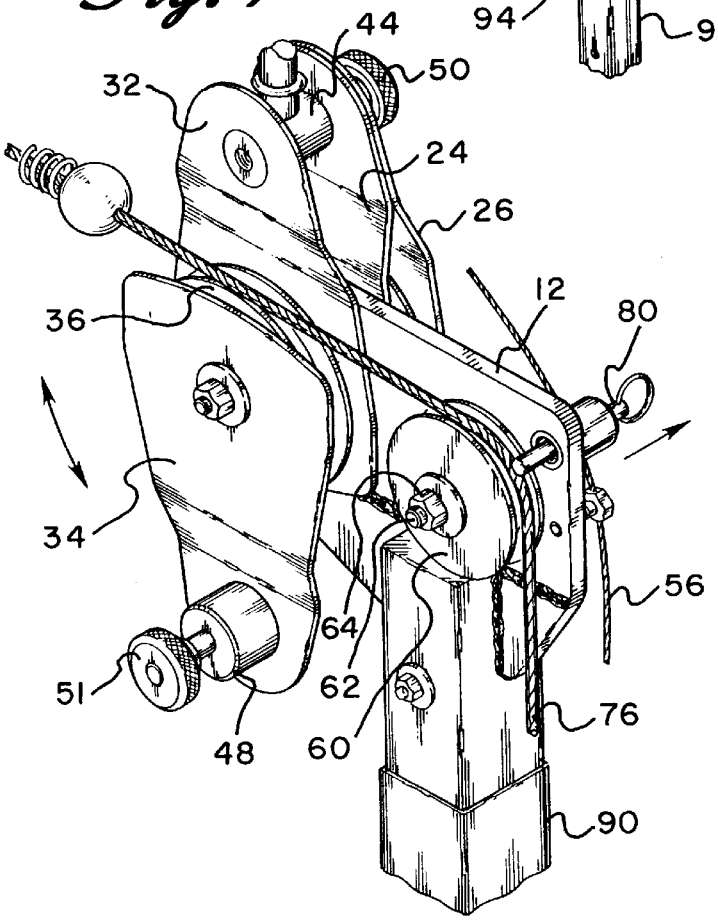
FIG. 7 is a partial perspective view of the upper section of the monopod anchoring device.
Figure 9:
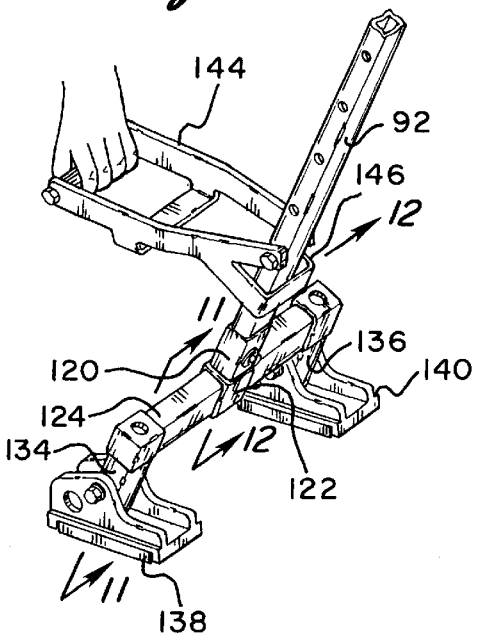
FIG. 9 is a perspective view of the handle portion of the present invention.
Figure 10:
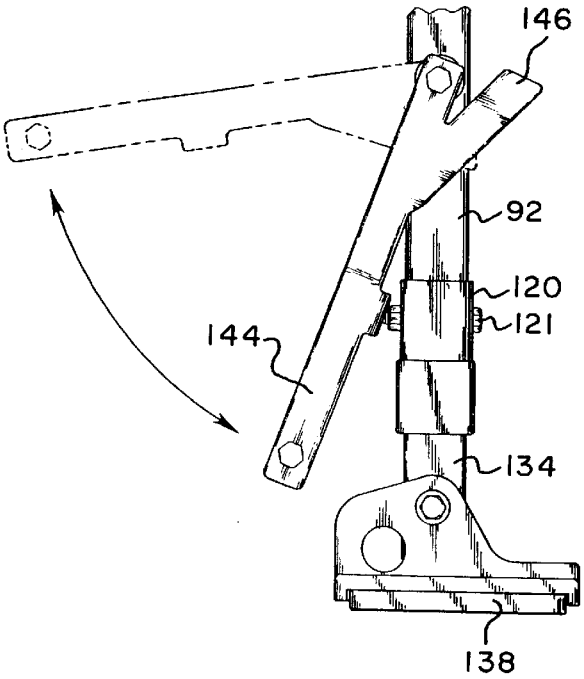
FIG. 10 is a side view of the handle portion.
Figure 11:
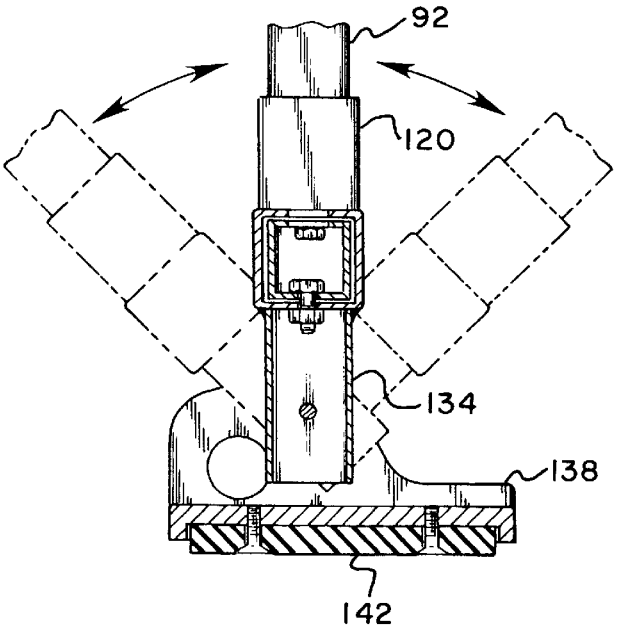
FIG. 11 is a partial side cross-sectional taken along lines 11—11 of FIG. 9.
Figure 12:
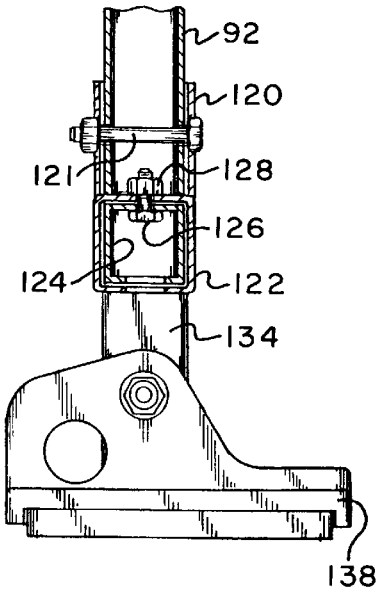
FIG. 12 is a partial side cross-sectional taken along lines 12—12 of FIG. 9.

A secondary pulley 60 is secured to the head member 12 adjacent pulley 36 as shown in FIG. 7. More specifically, a screw 62 is inserted through the head member and the axle of the pulley and is secured in place by a nut 64.

In the preferred embodiment, the leg member 14 is comprised of a first tubular portion 90 and a second tubular portion 92 (see FIG. 1). The top end of the first tubular portion 90 is secured to the head member 12 and its bottom end is telescopically mounted over the second tubular portion 92 so that the same extends up into the portion 90. A pair of holes are formed through opposing side walls of the first tubular portion adjacent the bottom thereof. The second tubular portion has a plurality of hole pairs 94 formed through opposing side walls along the length thereof. In order to secure the first tubular portion to the second tubular portion, a pin 96 is inserted through the holes in the first tubular portion and a corresponding hole pair 94 in the second tubular portion at a predetermined position (see FIGS. 1 and 8).

The support assembly 18 preferably includes safety device 66 and a winch assembly 68. Safety device 66 is of the type generally known in the industry and includes a housing 70 with a drum (not shown) and a drum shaft (not shown) mounted therein. A safety line 72 is adapted to be wound around the drum and has one end secured thereto. The other end of the line 72 is fed over pulley 28 between plate members 24 and 26 and is adapted to be connected to the object, such as a workman, to be raised or lowered. A centrifugal brake means is also mounted within the housing in order to prevent rapid rotation of the drum and therefore rapid unwinding of the safety line 72. The object is raised or lowered by turning crank 74 clockwise or counterclockwise.

Winch assembly 68 is also of conventional construction. Safety line 76 is wound around a drum and has one end secured thereto. The other end of the line 76 is fed over pulley 60 and over pulley 36 and is also secured to the object to be raised or lowered. Crank 78 is rotated in order to raise or lower the object. It should be noted that other known winding devices can be used in place of safety device 66 and/or winch assembly 68.

Figure 6:
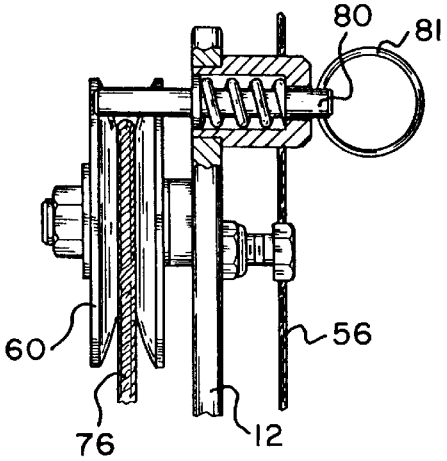
FIG. 6 is cross-sectional view taken along lines 6—6 of FIG. 4.

Referring to FIGS. 6 and 7, a spring loaded pin 80 extends through the head member 12, and passes over the line 76. The pin prevents the safety line 76 from being accidentally removed from the grooved wheel of the pulley 60. Pin 80 preferably has a ring 81 inserted through one end to facilitate the gripping of the same by a workman.

Figure 8:
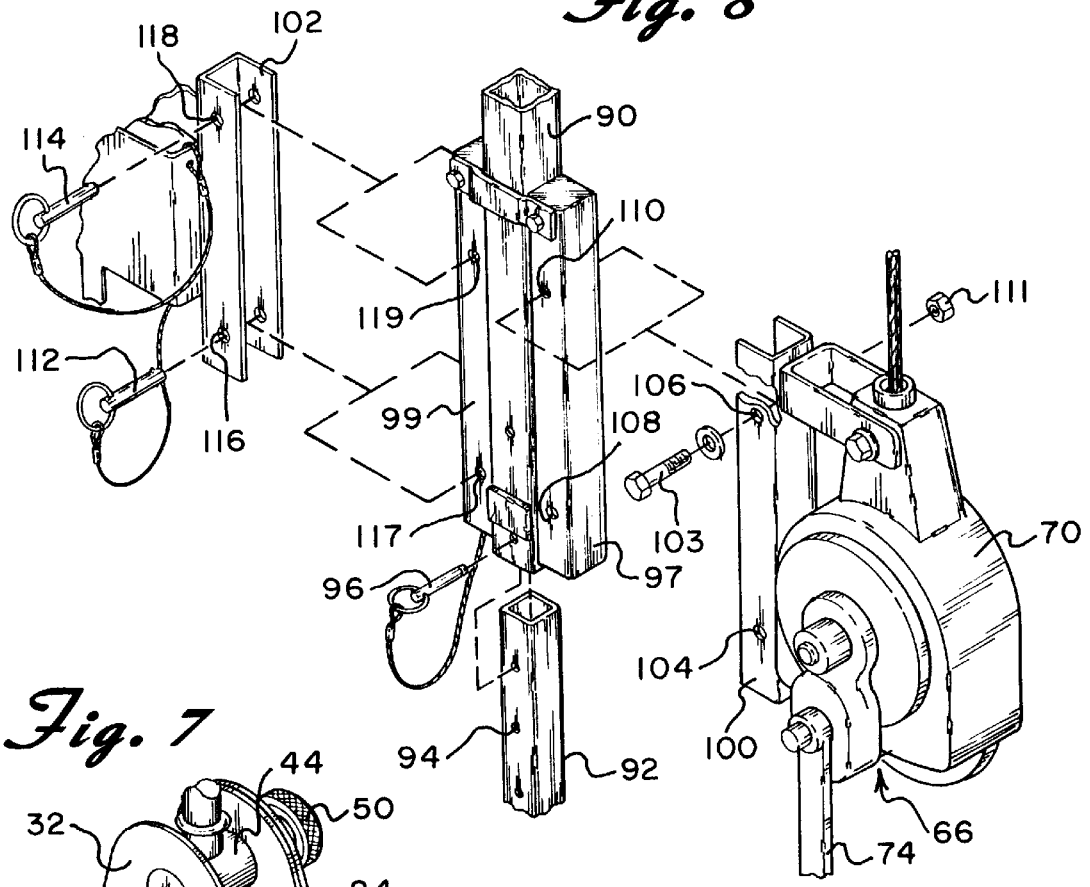
FIG. 8 is a partial exploded view of a portion of the present invention.

Support tubes 97 and 99 are secured to opposing side walls of the first tubular portion 90. The safety device 66 and winch assembly 68 are removably secured to the support tubes 97 and 99 by means of a corresponding U-shaped bracket 100 and 102 as best seen in FIG. 8. More specifically, the housing 70 of safety device 66 is secured to U-shaped bracket 100. U-shaped bracket 100 is positioned over support tube 97 and is secured thereto by bolts 103 which are inserted through hole pairs 104 and 106 formed in U-shaped bracket 100 and hole pairs 108 and 110 formed in the support tube 97. The bolts 103 are held in place by nuts 111. Winch assembly 68 is secured to U-shaped bracket 102. Bracket 102 is positioned over support tube 99 and is secured thereto by pins 112 and 114 which are inserted through hole pairs 116 and 118 formed in the bracket and through hole pairs 117 and 119 in the support tube 99.

Referring to FIGS. 9–12, a connecting member 120 is secured to the bottom of the second tubular portion 92 by bolt 121. The connecting member 120 has a hollow shaft 122 extending from the bottom thereof. A transverse cross member 124 extends through the hollow shaft 122 and is secured thereto by bolt 126 and nut 128. (see FIG. 12). Extending downwardly from opposite ends of the transverse cross member 124 are legs 134 and 136. Feet 138 and 140 are each rotatably mounted to a corresponding one of the legs 134 and 136. In the preferred embodiment, each foot has a rubber pad 142 secured to the bottom thereof for frictionally engaging the ground or other support structure.

A handle 144 is pivotally secured to the second tubular portion 92. When the handle 144 is grasped by a workman, it swings upwardly until segment 146 of the handle contacts the second tubular portion 92. When such contact is made, additional force applied by the workman causes the monopod anchoring device 10 to be lifted off the ground.

To facilitate an understanding of the principles associated with the foregoing device, its operation will now be briefly described. Before the monopod anchoring device 10 is used, an eyelet 150 is installed to an overhead beam 152 (see FIG. 1). The eyelet 150 is left in place for future use. The safety device 66 and the winch assembly 68 are preferably removed from leg member 14 and placed on a support surface before the device is secured to the eyelet 150. This is because the safety device and winch assembly are relatively heavy and hamper the ability of a workman to maneuver the monopod anchoring device.

The safety device 66 is removed from the leg member 14 by first unthreading nuts 111 from bolts 103 and then removing the bolts from the holes 104, 106, 108 and 110 in bracket 100 and support tube 97. Thereafter, bracket 100 and the attached safety device 66 are removed from the support tube. In order to remove winch assembly 68 from leg member 14, pins 112 and 114 are pulled away from bracket 102. Bracket 102 and the attached winch assembly 68 are then pulled away from the support tube 99.

With the safety device and the winch assembly removed, the monopod anchoring device can readily be transported to a desired location. The device 10 is then secured in place by positioning hook 52 near the eyelet 150 which extends downwardly from overhead beam or support structure 152 (see FIG. 1). A workman can pull back on the wire 56 which causes arm 54 to be similarly pulled back so that the hook is opened and can be inserted through the eyelet. When the wire 56 is released, the arm 54 closes the hook and thereby secures the same to the eyelet and helps prevent accidental removal therefrom. The handle 144 is lifted so that the monopod anchoring device can be properly positioned on the structure which surrounds the cavity into which the workman will be lowered. Thereafter, the safety device 66 and the winch assembly 68 are reconnected to the leg member 14. Finally, the ends of the safety lines 72 and 76 are secured to the harness of the workman so that he or she can move downwardly into the cavity and safely perform the requisite function.

Both the safety device 66 and the winch assembly 68 can be totally removed from the monopod anchoring device 10. More specifically, safety device 66 can be removed by first detaching safety line 72 from the pulley 28. This is accomplished by rotating screw 50 so that the threaded end is withdrawn from the threaded recess 43. Thereafter, the plate member 26 is free to rotate so the safety line 72 can be lifted up off the pulley 28 and removed from the same. The safety device 66 can the be removed from the leg member 14 in the manner described above.

The winch assembly 68 can be removed by pulling ring 81, which is secured to the spring loaded pin 80, away from pulley 60 so that the safety line 76 can be lifted and removed from the pulley 60. Thereafter, screw 51 is unthreaded from protrusion 48 so plate member 34 can be rotated in order to allow the safety line 76 to be lifted up off the pulley 36. As stated above, total removal of the screw 51 is prevented by the stop element 53 mounted thereon. With the safety line removed from pulleys 36 and 60, the winch assembly 68 can be removed from the device.

The present invention may be embodied in other specific forms without departing from the spirit or essential attributes thereof and accordingly reference should be made to the appended claims rather than to the foregoing specification as indicating the scope of the invention.

What is claimed is:

1. A monopod anchoring device for facilitating the safe entry or removal of an object into or out of a cavity comprising:

an elongated leg member having an upper end and a lower end;

a snap hook secured to said leg member adjacent said upper end of said leg member and extending upwardly therefrom, said snap hook having a swivel arm;

means for opening said snap hook including a wire having one end secured to said swivel arm of said snap hook, said swivel arm being adapted to pivot about said snap hook upon application of a force to said wire in order to open said snap hook;

a winding device secured to said leg member intermediate said upper and lower ends, said winding device including a housing with a drum and a drum shaft rotatably mounted therein and a safety line adapted to be wound around said drum, said safety line having one end secured to said drum and an opposing end adapted to be connected to said object to be raised or lowered;

pulley means mounted to said leg member at a position above said winding device, said safety line of said winding device passing over said pulley means, and at least one foot extending downwardly from said leg member.

2. The device of claim 1 wherein said hook is rotatable about said leg member.

3. The device of claim 1 wherein said leg member includes a first tubular portion telescopically mounted over a second tubular portion.

4. The device of claim 3 further including means for selectively securing said first tubular portion along the length of said second tubular portion.

5. The device of claim 1 further including a transverse cross member secured to the lower end of said leg member, said foot extending downwardly from said transverse cross member.

6. The device of claim 1 further including a handle pivotally secured adjacent the lower end of said leg member.

7. The device of claim 1 further including a winch assembly having a frame with a drum and a drum shaft rotatably mounted between said frame and a safety line adapted to be wound around said drum, said safety line having one end secured to said drum and another end adapted to be connected to said object to be raised or lowered.

8. The device of claim 7 further including a secondary pulley means secured adjacent said upper end of said leg member, said safety line of said winch assembly passing over said secondary pulley means.

9. The device of claim 8 further including a pulley secured to said leg member adjacent said secondary pulley means, said safety line of said winch assembly passing over said secondary pulley means.

10. The device of claim 9 further including means for preventing accidental removal of said safety line from said pulley.

11. The device of claim 10 wherein said preventing means includes a pin inserted through said leg member and extending immediately above said secondary pulley means.

12. A monopod anchoring device for facilitating the safe entry or removal of an object into or out of a cavity comprising:

a head member;

a snap hook secured to said head member and extending upwardly from said head member, said snap hook having a swivel arm;

means for opening said snap hook including a wire having one end secured to said swivel arm of said snap hook, said swivel arm being adapted to pivot about said snap hook upon application of a force to said wire in order to open said snap hook;

an elongated leg member extending downwardly from said head member;

a winding device secured to said leg member, said winding device including a housing with a drum and a drum shaft rotatably mounted within said housing, a safety line adapted to be wound around said drum and having one end secured thereto, the other end of said line being adapted to be connected to said object to be raised or lowered;

pulley means mounted adjacent one side of said head member, said safety line of said winding device passing over said pulley means, and at least one foot extending downwardly from said leg member.

13. The device of claim 12 wherein said hook is rotatable about said leg member.

* * * * *